US006074611A

United States Patent [19]

Flesher

[11] Patent Number: 6,074,611

[45] Date of Patent: Jun. 13, 2000

[54] MICRO-PIPETTOR APPARATUS

[75] Inventor: Robert W. Flesher, Baltimore, Md.

[73] Assignee: Apogee Designs, Ltd., Baltimore, Md.

[21] Appl. No.: 09/067,016

[22] Filed: Apr. 28, 1998

Related U.S. Application Data

[60] Provisional application No. 60/044,551, Apr. 28, 1997.

[51] Int. Cl.[7] ..... B01L 3/02

[52] U.S. Cl. ..... 422/100; 73/863.32; 73/864.11; 222/137

[58] Field of Search ..... 73/863.32, 864.01, 73/864.02, 864.11, 864.14; 422/100; 222/137

[56] References Cited

U.S. PATENT DOCUMENTS

| | | | |
|---|---|---|---|
| 3,982,438 | 9/1976 | Byrd | 73/863.32 |
| 4,215,092 | 7/1980 | Suovaniemi et al. | 73/863.32 |
| 4,511,534 | 4/1985 | Bennet et al. | 73/863.32 X |
| 4,527,437 | 7/1985 | Wells | 73/864.11 |
| 4,801,434 | 1/1989 | Kido et al. | 73/863.32 X |
| 4,909,991 | 3/1990 | Oshikubo | 73/864.14 X |
| 5,445,797 | 8/1995 | Flesher | 422/100 |
| 5,747,709 | 5/1998 | Oshikubo | 422/100 X |
| 5,770,160 | 6/1998 | Smith et al. | 422/100 |

*Primary Examiner*—Chris K. Moore
*Attorney, Agent, or Firm*—Sterne, Kessler, Goldstein & Fox P.L.L.C.

[57] ABSTRACT

A pipettor operable by a lateral pushing movement of a thumb of a user. The pipettor includes an ergonomically designed non-tubular body that has an operating surface and a supporting surface. The body of the pipettor is configured to be grasped between the thumb placed on the operating surface and at least one finger placed on the supporting surface in an opposing manner. The pipettor includes one or more fluid pick-up means disposed in the body of the pipettor for drawing a calibrated volume of fluid into the pipette tip. The fluid pick-up means is operable by the lateral pushing movement of the thumb against the operating surface of the body of the pipettor. Dispensing means is provided for dispensing the calibrated volume of fluid from the pipette tip. The dispensing means is operable by the lateral pushing movement of the thumb against the operating surface. A tip holder is coupled to the body and is configured to mate with a pipette tip. Ejecting means for ejecting the pipette tip from the tip holder is disposed in the body of the pipettor. A pipetting apparatus is also disclosed that provides for simultaneously performing multiple pipetting operations.

27 Claims, 4 Drawing Sheets

MICRO-PIPETTOR APPARATUS

This application claims the benefit of U.S. Provisional Application Ser. No. 60/044,551, filed Apr. 28, 1997.

BACKGROUND OF THE INVENTION

1. Field of the Invention

The present invention relates generally to pipettors. More particularly, the present invention relates to micro-pipettors used with a pipette tip.

2. Related Art

Pipettors are used to transfer fluid, preferably precise quantities of fluid. Pipettors are typically used for adding precise quantities of reagents, samples, or other types of fluids to test tubes, micro-titer wells, microscope slides, and the like. A micro-pipettor is used to dispense quantities of fluid in the micro-liter ($\mu l$) range. The micro-pipettor is generally used with a pipette tip. The pipette tip typically has a very fine bore at one end through which fluid is drawn or pulled into, and expelled from, the pipette tip. The micro-pipettor to which the pipette tip is mated provides suction so that fluid is drawn into the pipette tip. The micro-pipettor can also exert a pressure in the pipette tip to expel the fluid from the pipette tip.

Conventional pipettors are configured with elongated, tubular bodies. To perform pipetting operations with such a conventional pipettor, a user's hand and arm must be in an elevated position, typically twelve to eighteen inches above the working level of the slides, test tubes, or other receptacles being used. Working with the hand and arm at the elevated position results in fatigue faster than working with the hand and arm at a position closer to the working level of the receptacles. Working at the elevated position for an extended period of time can even lead to pain and injury for the user. Further, working at the elevated position makes the fragile pointed tip of the pipettor more difficult to control, and can result in inaccurate pipetting or even piercing a gel into which the pipetting may be done. Having the user's hand and arm closer to the working level would provide better movement feedback to the user, thereby resulting in better control and a more accurate pipetting operation.

One type of conventional pipettor is a squeeze-bulb pipettor that is equipped with a squeeze bulb to draw fluid into and expel fluid from the pipettor. With such a squeeze bulb pipettor, the user holds the pipettor with one hand, and squeezes the bulb with the other to draw and expel liquid. Such two-handed operation is cumbersome, and does not allow the user a free hand to perform such tasks as aligning the pipettor, moving the reagent bottles, moving the slides or receptacle trays, etc.

Other conventional pipettors are configured for one hand operation. Such conventional pipettors typically include a movable piston or plunger to draw fluid into and expel fluid out of the pipette tip. The tubular body of the pipettor is grasped by encircling some or all of the four fingers of the hand around the pipettor. The piston is moved by longitudinal (up and down) movement of the thumb. In some conventional pipettors, longitudinal movement of the thumb is used to draw fluid into the pipette tip, and a trigger mechanism operable by one of the fingers is provided to expel the fluid from the pipette tip. These conventional pipettors require repeated up and down movement of the thumb, typically when the hand and arm are in an elevated position. Repetitive movement of the thumb in this manner over extended periods of time is not only uncomfortable, but can lead to pain and stress injuries. An alternative to thumb-operated pipettors is disclosed in U.S. Pat. No. 5,445,797. This patent discloses an elongated tubular pipettor that is held in a user's hand like a pen. In this position, the user's index finger is used to depress and release pressure on a flexible member to draw fluid into, and expel fluid from, the pipette tip.

Conventional pipettors use a variety of techniques to dispense a precise or calibrated quantity of fluid. For example, U.S. Pat. No. 5,125,278 discloses a volumetric squeeze-bulb type pipette having two branches. A liquid sample is drawn up into one branch by squeezing a bulb, and a precise volume is expelled by squeezing a bulb on the second branch. Other pipettors are calibrated so that a linear movement of the piston is related to a volume change within the pipettor. A precision mechanical control mechanism is used to move the piston, and to relate the distance moved to the volume of liquid either pulled in or pushed out of the pipettor.

Micro-pipettors can use a graduated pipette tip to dispense a calibrated quantity of fluid. Such a graduated pipette tip includes graduation marks that are calibrated to measure precise quantities of fluid drawn into the pipette tip. The pipette tips are made from a transparent or translucent material to allow the user to visually compare the level of fluid drawn into the pipette tip with the graduation marks. In other micro-pipettors, linear movement of a piston or plunger is related to change in volume. In such micro-pipettors, a precision mechanical control mechanism is used to move the piston, and to relate the distance moved to the volume of liquid either pulled in or pushed out of the micro-pipettor. The pen pipettor disclosed in U.S. Pat. No. 5,445,797 provides for a coarse draw calibration by limiting the draw of the pipettor. However, it has been found in practice that although such a coarse draw calibration provides a reproducible quantity of fluid, it does not provide an accurate quantity of fluid. Therefore, such a coarse draw calibration cannot be relied upon to provide an accurate quantity of fluid.

Conventional pipettors do not take advantage of the natural opposable movement between the thumb, and fingers and palm of a user's hand. Thus, there is a need in the art for an ergonomically designed pipettor that allows all pipetting operations to be performed with one hand, and that accurately dispenses a calibrated quantity of fluid. Conventional pipettors also do not provide a way to easily perform multiple simultaneous pipetting operations. Thus, there is a further need in the art for a pipetting apparatus that can be easily configured to perform multiple simultaneous pipetting operations.

SUMMARY OF THE INVENTION

In one aspect, the present invention provides a pipettor operable by a lateral pushing movement of a thumb of a user. The pipettor includes a non-tubular body that has an operating surface and a supporting surface. The body of the pipettor is configured to be grasped between the thumb placed on the operating surface and at least one finger placed on the supporting surface in an opposing manner. The body of the pipettor defines an air channel that has an end open to the exterior of the body, forming an opening. A tip holder is coupled to the body at the opening at the end of the interior air channel. The end of the tip holder remote from the body of the pipettor is configured to mate with a pipette tip.

The pipettor further includes one or more fluid pick-up means disposed in the body of the pipettor for drawing a calibrated volume of fluid into the pipette tip. The fluid pick-up means is operable by the lateral pushing movement of the thumb against the operating surface of the body of the pipettor. In a further aspect of the present invention, the fluid pick-up means comprises a pick-up poppet disposed on the operating surface. Deflection of the pick-up poppet by the lateral pushing movement of the thumb displaces a volume of air in the air channel so that a calibrated volume of fluid is drawn into the pipette tip. The pipettor can also include a second pick-up poppet disposed on the operating surface. The second pick-up poppet is used to draw a second calibrated volume of fluid into the pipette tip. The second calibrated volume of fluid can be different than the first calibrated volume of fluid. The pick-up poppets can be configured as deformable stainless steel disks.

The pipettor includes dispensing means disposed in the body of the pipettor for dispensing the calibrated volume of fluid from the pipette tip. The dispensing means is operable by the lateral pushing movement of the thumb against the operating surface. In a further aspect of the present invention, the dispensing means comprises a dispense poppet disposed on the operating surface. Deflection of the dispense poppet by the lateral pushing movement of the thumb displaces a volume of air in the interior air channel greater than the volume of air displaced by the pick-up poppet so that the calibrated volume of fluid is dispensed from the pipette tip.

In a further aspect of the present invention, an ejecting means is provided. The ejecting means can include a lever having two ends that each extend from the body of the pipettor. One end of the lever extends from the body of the pipettor adjacent to the tip holder. Biasing means, such as a spring, is provided to bias the lever in a non-contacting position. In the non-contacting position, the end of the lever adjacent to the tip holder is free from contact with the pipette tip. Depressing the other end of the lever causes the lever to move, and to push the pipette tip from the tip holder. When the lever is released, the biasing means causes the lever to return to the non-contacting position.

In yet a further aspect of the present invention, a pipetting apparatus is provided. The pipetting apparatus includes a tip plate that defines a tip plate air channel. A tip holder is coupled to the tip plate so that a central bore of the tip holder is substantially aligned with the tip plate air channel. An end of the tip holder remote from the tip plate is configured to mate with apipette tip. A poppet plate is provided that defines a poppet plate air channel. The poppet plate is disposed on the tip plate so that a first end of the poppet plate air channel is substantially aligned with the tip plate air channel. A poppet is disposed on the poppet plate at a second end of the poppet plate air channel remote from the first end. A pin plate is disposed in facing relation to the poppet plate. A poppet pin is coupled to the pin plate so that the poppet pin extends toward the poppet plate. When the pin plate and the poppet plate are drawn together, the poppet pin deflects the poppet to thereby displace air in the poppet plate air channel and the tip plate air channel so that fluid can be drawn into or expelled from the pipette tip. The pipetting apparatus can be advantageously configured with a plurality of tip holders, air channels, poppets, and poppet pins so that multiple simultaneous pipetting operations can be performed.

In another aspect of the present invention, the pipetting apparatus can include a guide pin coupled to the pin plate so that the guide pin extends toward the poppet plate, and a guide channel defined by the poppet plate for receiving the guide pin when the pin plate and the poppet plate are drawn together.

Features and Advantages

It is a feature of the present invention that it can be operated by a lateral pushing movement of a thumb of a user. It is a further feature of the present invention that it is configured to be grasped between the thumb and at least one finger in an opposing manner.

It is a further feature of the present invention that the device itself picks up and dispenses a calibrated volume of fluid, thereby eliminating the need to use graduated pipette tips.

It is yet a further feature of the present invention that multiple simultaneous pipetting operations can be performed.

An advantage of the present invention is its ergonomic design. The ergonomic design allows the device to be operated in a side-to-side or lateral manner, using the natural opposable relationship between the thumb, and the fingers and palm of a hand.

A further advantage of the ergonomic design of the present invention is that the device is easier to use. The height at which the device must be held for operation is reduced, so that the user's hand and arm does not have to be held in an elevated position.

The ergonomic design of the present invention is further advantageous because it does not have a long tubular body, thereby making it easier to hold.

Another advantage of the present invention is that a user can perform all pipetting operations with one hand. Fluid can be drawn into and expelled from the device with one hand. Additionally, pipette tips can be ejected and exchanged with one hand, without having to put down and pick up the device.

It is yet a further advantage of the present invention that it can be configured for ergonomic use by both a left-handed user and a right-handed user.

A still further advantage of the present invention is that it can be configured to simultaneously perform multiple pipetting operations.

BRIEF DESCRIPTION OF THE FIGURES

The present invention is described with reference to the accompanying drawings. In the drawings, like reference numbers indicate identical or functionally similar elements. Additionally, the left-most digit of a reference number identifies the drawing in which the reference number first appears.

DETAILED DESCRIPTION OF THE PREFERRED EMBODIMENTS

In one aspect, the present invention is directed to an ergonomically designed pipettor that allows all pipetting operations to be performed with one hand, and that accurately dispenses a calibrated quantity of fluid. The pipettor of the present invention takes advantage of the natural opposable relationship between the thumb, and the fingers and palm of a hand. The present invention is designed to be grasped between the thumb and the fingers and palm of one hand in an opposing manner. To operate the device, the thumb is moved in a side-to-side or lateral manner, pushing the device against the fingers and palm of the hand. This provides a natural and comfortable way to operate the pipettor, particularly over an extended period of time. Additionally, the pipettor of the present invention has a non-tubular body that is shaped to fit and rest comfortably in the hand. Consequently, the hand and arm of the user do not have to be elevated to use the pipettor, thereby increasing the comfort and ease of its use.

In another aspect of the present invention, a pipetting apparatus is provided that can simultaneously perform multiple pipetting operations. The pipetting apparatus can be configured with multiple pipette tips so that fluid can be simultaneously drawn into, or expelled from, the pipette tips.

The term "fluid" is used herein to refer generally to any medium that can be drawn into and expelled from a pipettor. As used herein, the term "poppet" refers to a deformable convex disk that can be depressed to assume a concave or flattened shape. When the disk is released, it snaps or pops back to its convex shape. The disk can be substantially circular, or have a variety of other shapes. For example, the disk can also have a square or rectangular shape, or have a central circular region with protruding ears.

Figure 1A:
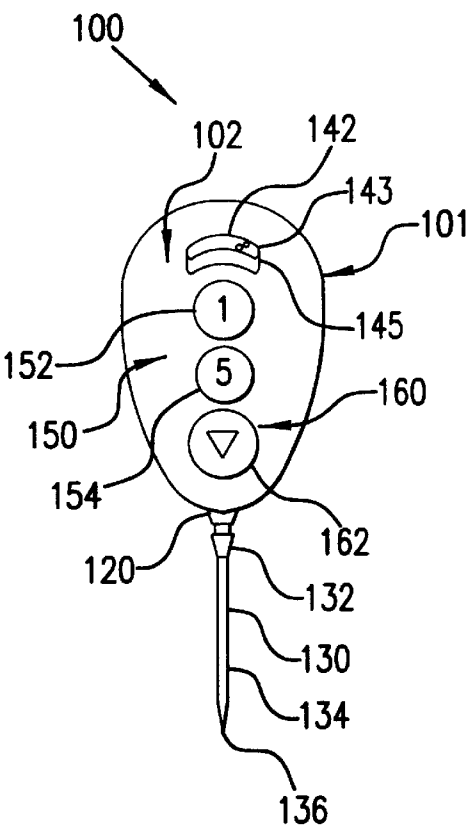
FIG. 1A shows a front view of one embodiment of a pipettor of the present invention.
Figure 1B:
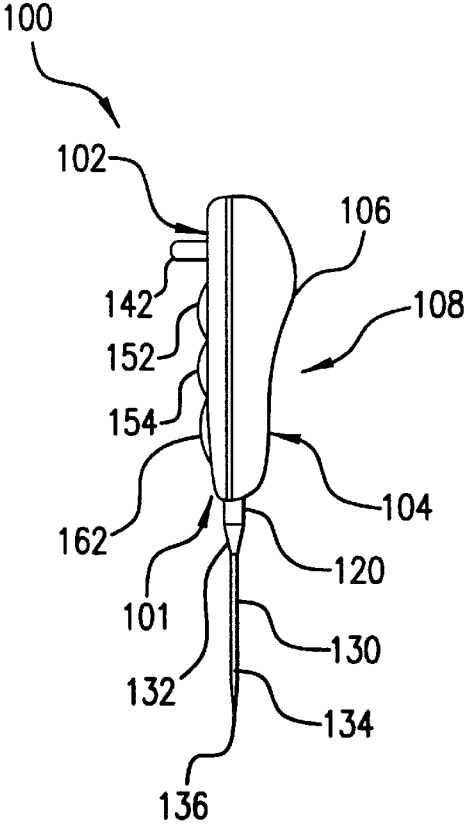
FIG. 1B shows a side view of the embodiment shown in FIG. 1A.

Turning now to FIG. 1A, a pipettor 100 having a non-tubular body 101 is shown. Non-tubular body 101 is preferably made from a thermoplastic material, and formed by injection molding techniques known in the art. Suitable materials include ABS (acrylonitrile-butadiene-styrene) plastic, polysulfone, or polycarbonate. Other techniques known to the skilled artisan can be used to form non-tubular body 101. For example, non-tubular body 101 could be cast from liquid polyurethane. Non-tubular body 101 can be injection molded as a single unitary piece, or it can be injection molded as more than one piece that are joined together. As shown in FIGS. 1A and 1B, non-tubular body is of a flattened egg like shape, with a length of approximately 4 inches and a thickness of approximately one inch at the thickest point. The shape and dimensions shown in the figures for non-tubular body 101 are exemplary in nature, and it should be understood that the present invention is not limited to the illustrated shape and exemplary dimensions.

Pipettor 100 is configured for use with a pipette tip 130. A tip holder 120 is provided for mating with pipette tip 130. As shown in FIGS. 2A and 2B, one end 222 of tip holder 120 is coupled to non-tubular body 101. A tapered end 224 of tip holder 120 mates with pipette tip 130. Tip holder 120 defames a central bore 226 that provides for air communication with an air channel 210. Air channel 210 will be explained in more detail below with respect to FIGS. 2A–2C. Tip holder 120 can be made from a plastic material, such as an opaque plastic material, or a clear or transparent plastic material, such as an acrylic plastic.

Pipette tip 130 is conically shaped, having a central bore or lumen open at both ends. At a wide end 132, pipette tip 130 is configured to mate with tapered end 224 of tip holder 120 by a friction fit to allow substantially air-tight coupling of the central bore of pipette tip 130 with central bore 226 of tip holder 120. At a narrow end 134 of pipette tip 130, an apex opening 136 is provided for drawing fluid into or expelling fluid from pipette tip 130. The pipettor of the present invention advantageously does not require the use of a pipette tip that has graduation marks calibrated to measure precise quantities of fluid drawn into the pipette tip. However, a pipette tip having graduation marks can be used with the pipettor of the present invention, even though such a pipette tip is not required to accurately dispense calibrated quantities of fluid. Pipette tips suitable for use with the present invention are commercially available, such as from BIO 101 in LaJolla, Calif. A scale-marked pipette tip suitable for use with the present invention is shown in U.S. Pat. No. 5,223,225, the entirety of which is incorporated herein by reference.

Pipettor 100 includes an ejecting means, shown generally at 140, for ejecting pipette tip 130 from tip holder 120. Ejecting means 140 allows the user to "pop off" or eject a used pipette tip so that it can be replaced with an unused or clean pipette tip. The used pipette tip can be popped off with ejecting means 140 with the same hand with which the user is holding pipettor 100. Preferably, clean pipette tips are held in a rack with the mating or wide end 132 facing upward. In this manner, a clean pipette tip can be pushed onto tip holder 120 after the used pipette tip has been popped off with ejecting means 140. This advantageously allows the user to exchange pipette tips with one hand (the same one holding pipettor 100), without having to put down and pick up the pipettor.

Figure 1C:
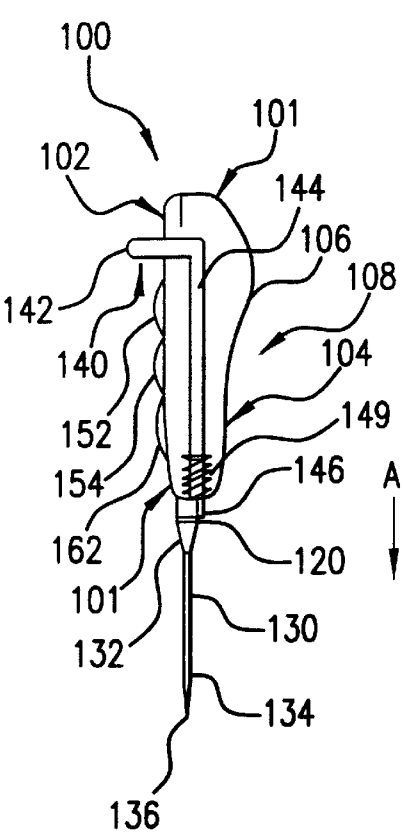
FIG. 1C shows a cutaway side view of the embodiment shown in FIG. 1B.

In the embodiment shown in FIGS. 1A–1C, ejecting means 140 comprises a lever 144. A first end 146 of lever 144 extends from non-tubular body 101 adjacent tip holder 120. The other end of lever 144, remote from end 146, also extends from non-tubular body 101 as a button 142. As shown in FIG. 1C, end 146 is in a non-contacting position where end 146 of lever 144 is free from contact with pipette tip 130. To eject pipette tip 130 from tip holder 120, the user depresses button 142. Button 142 is depressed from a non-eject position 143 (as shown in FIG. 1A) to an eject position 145. Depressing button 142 from non-eject position 143 to eject position 145 causes lever 144 to move in the direction shown in FIG. 1C by arrow A. This causes end 146 of lever 144 to move from the non-contacting position to a contacting position in contact with pipette tip 130 to push or eject pipette tip 130 from tip holder 120. Preferably, lever 144 moves approximately ⅛" between the non-contacting position and the contacting position to eject pipette tip 130.

Ejecting means 140 includes a biasing means 149 for biasing end 146 of lever 144 in the non-contacting position. After pipette tip 130 has been ejected from tip holder 120 by depressing button 142, button 142 is released. After release of button 142, biasing means 149 causes end 146 of lever 144 to return to the non-contacting position. Biasing means 149 can include, for example, a spring. It is to be understood that the present invention is not limited to the exemplary embodiment described above for ejecting means 140, and other types of ejecting means can be used with the present invention.

Pipettor 100 includes fluid pick-up means, shown generally at 150, for drawing fluid into pipette tip 130. In a preferred embodiment, fluid pick-up means 150 includes one or more pick-up poppets, such as pick-up poppet 152 and 154. Pick-up poppets 152 and 154 are disposed on an operating surface 102 of non-tubular body 101. Deflection of pick-up poppet 152 or 154, such as by the lateral pushing movement of the thumb of the user against operating surface 102, displaces a volume of air in air channel 210 (see FIGS. 2A–2C). When pick-up poppet 152 or 154 is released, it returns to its normal or undeflected position, thereby causing a calibrated volume of fluid to be drawn into pipette tip 130.

Pipettor 100 includes fluid dispensing means, shown generally at 160, for dispensing or expelling fluid from pipette tip 130. In a preferred embodiment, fluid dispensing means 160 includes one or more dispense poppets 162. Dispense poppet 162 is disposed on operating surface 102 of non-tubular body 101. Deflection of dispense poppet 162, such as by the lateral pushing movement of the thumb of the user against operating surface 102, displaces a volume of air in air channel 210. When dispense poppet 162 is released, it returns to its normal or undeflected position, thereby causing the fluid in pipette tip 130 to be dispensed or expelled.

The volume of air displaced by dispense poppet 162 is preferably greater than the volume of air displaced by pick-up poppet 152 or 154. The greater displacement by dispense poppet 162 allows the effects of surface tension to be overcome so that all of the fluid within pipette tip 130 can be completely expelled. For example, dispense poppet 162 can be configured so that dispense poppet 162 displaces twice the volume of air as pick-up poppet 152 or 154.

Non-tubular body 101 is shaped to fit and rest comfortably in a hand of the user. Non-tubular body 101 preferably includes a region 108 that is sculpted to fit either a left hand or a right hand. In this manner, non-tubular body 101 can be grasped and operated equally well by either a left-handed or a right-handed user. Non-tubular body 101 is configured to be operated by moving a thumb in a side-to-side or lateral manner to push non-tubular body 101 against the fingers and palm of the hand. As shown in FIGS. 1B and 1C, the rear or back of non-tubular body 101 includes a supporting surface 104 having a support ledge 106. Support ledge 106 provides a support against which the fingers of the hand can rest. Support ledge 106 aids the user in grasping and operating pipettor 100 with either the left hand or the right hand.

To draw fluid into pipette tip 130, the user laterally moves the thumb so that it depresses pick-up poppet 152 or 154. The user then laterally moves the thumb so that pick-up poppet 152 or 154 is released, thereby causing a calibrated volume of fluid to be drawn into pipette tip 130. To dispense the drawn fluid, the user laterally moves the thumb so that it depresses dispense poppet 162. The user then laterally moves the thumb so that dispense poppet 162 is released, thereby causing the calibrated volume of fluid to be dispensed or expelled from pipette tip 130.

To exchange pipette tips, the user first ejects the used pipette tip currently positioned on tip holder 120. To do so, the user depresses button 142, for example by pushing downward in the direction shown by arrow A with a finger or thumb, so that pipette tip 130 is pushed or ejected from tip holder 120 by lever 144. When button 142 is released, lever 144 returns to its undepressed position, with end 146 in the non-contacting position. Pipettor 100 is now ready for a new pipette tip to be pushed onto tip holder 120.

Figure 2C:
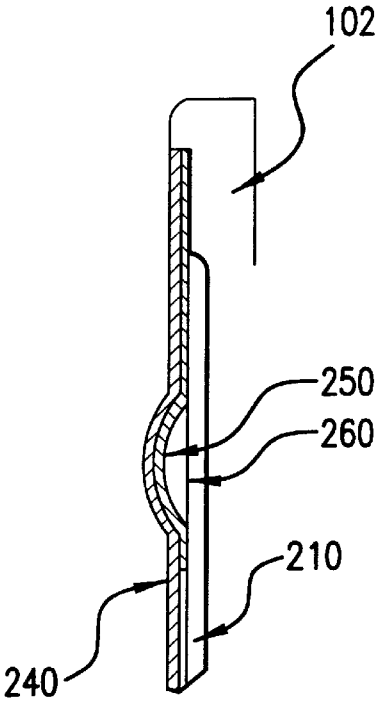
FIG. 2C shows a partial cross-section of the pipettor body.
Figure 2B:
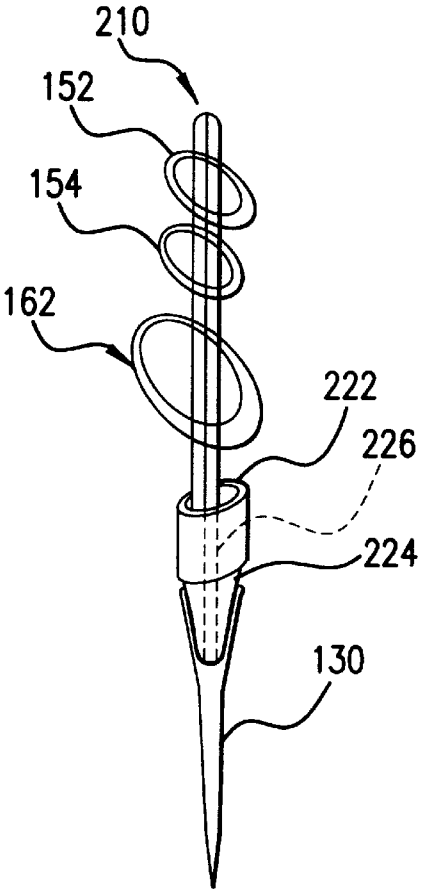
FIG. 2B shows an exploded view of the air channel and poppets.
Figure 2A:
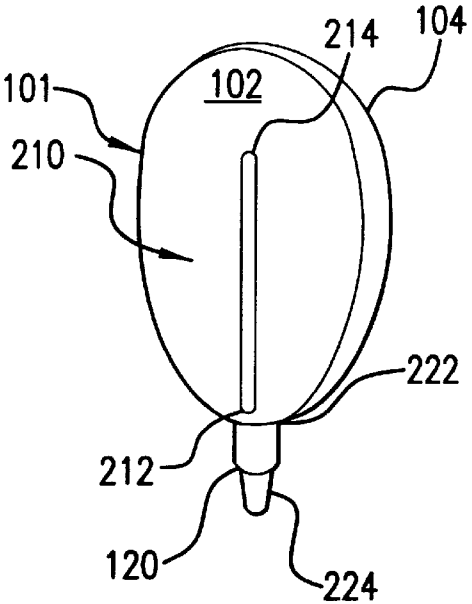
FIG. 2A shows a perspective view of the pipettor body and air channel.

Turning now to FIGS. 2A–2C, the configuration of air channel 210 will be explained in more detail. Air channel 210 can be formed in operating surface 102 of non-tubular body 101 by configuring a channel in the injection mold, or machining a small channel into operating surface 102, in a well known manner. Because the displaced volume of air in a micro-pipettor is small, air channel 210 can also be small. A channel significantly larger than the displaced volume of air is not only unnecessary, but can induce errors in the displaced volume. As shown in FIG. 2A, air channel 210 has an end 212 open to the exterior of non-tubular body 101 and a closed end 214. End 212 forms an opening in non-tubular body 101 that mates with end 222 of tip holder 120.

FIG. 2B shows an exploded view of air channel 210 and pick-up poppets 152 and 154 and dispense poppet 162. Pick-up poppets 152 and 154 and dispense poppet 162 are each disposed on air channel 210. Air channel 210 mates with central bore 226 of tip holder 120 to provide for air flow into and out of air channel 210.

FIG. 2C shows a partial cross-section of the pipettor body, with air channel 210 formed in operating surface 102. For purposes of illustration, a single poppet 250 is shown disposed on air channel 210. Poppet 250 is intended to be illustrative of, for example, pick-up poppets 152, 154 and dispense poppet 162. The volume of air displaced by deflection of poppet 250 is shown generally at 260. A sealing label 240 is shown disposed on the outer surface of operating surface 102. Preferably, sealing label 240 extends over the entire outer surface of operating surface 102. Sealing label 240 performs the following functions: sealing air channel 210; sealing poppet 250 in its proper location on operating surface 102; and providing graphics for pipettor 100. Sealing label 240 is preferably made from a thin (less than approximately 0.005") polycarbonate material. Sealing label 240 can be silk-screened on the back side with graphics, and then laminated with a permanent pressure sensitive adhesive to securely adhere it to operating surface 102 of non-tubular body 101. As such, operating surface 102 should be kept flat, or only lightly radiused, to allow for sealing of air channel 210 by sealing label 240. A sealing label, such as sealing label 240, can be used on operating surface 102 of pipettor 100 shown in FIG. 1A to provide the graphics shown on pick-up poppets 152,154 and dispense poppet 162.

The poppets used in the present invention for pick-up poppets 152, 154 and dispense poppet 162 are preferably deformable stainless steel convex disks that can be depressed to assume a concave or flattened shape. For example, the poppets are depressed from the convex position shown in FIG. 2C until they are substantially flush with operating surface 102, thereby providing tactile feedback to the user. When the poppet is released, it snaps or pops back to its convex shape. The poppet makes a popping or snapping sound when it is depressed and when it is released, thereby providing aural feedback to the user.

Such deformable stainless steel convex disks have been conventionally used, for example, to provide electrical contact for membrane switches found in electronic devices. The inventor of the present invention has unexpectedly found that such deformable stainless steel convex disks displace a constant volume of air. Consequently, release of such deformable stainless steel convex disks draws a constant volume of fluid into pipette tip 130. By adjusting the size and shape of the deformable stainless steel convex disks, the volume of fluid drawn into pipette tip 130 can be changed. In this manner, such deformable stainless steel convex disks can be used to draw a constant and calibrated volume of fluid into pipette tip 130.

The size and shape of the poppets used for a particular application can be determined by one of skill in the art by considering the volume of air to be displaced, the severity of the snap, and the finger pressure needed to actuate or deflect the poppet. If the poppet provides too much snap, the fluid can be displaced from the pipette tip in an undesirable sudden jet, rather than in a more continuous, laminar-like stream or flow. A softer acting, larger diameter poppet should be used to preclude a jet discharge from the pipette tip. The finger pressure needed to actuate the poppet is dependent upon the thickness of the poppet, the diameter of the poppet, the displacement of the poppet, and its perimeter geometry (e.g., circular, circular with protruding ears, etc.).

Pick-up poppet 152 and 154 can be configured so that the calibrated volume of fluid drawn into pipette tip 130 is the same. Alternatively, pick-up poppets 152 and 154 can be configured so that the calibrated volume of fluid drawn into pipette tip 130 by one poppet is different (i.e., greater or less) than the calibrated volume of fluid drawn into pipette tip 130 by the other poppet. In a particularly preferred embodiment, one pick-up poppet is configured to draw a volume of fluid substantially equal to 5 $\mu$l (micro-liters) into pipette tip 130, and the other pick-up poppet is configured to draw a volume of fluid substantially equal to 2 $\mu$l into pipette tip 130.

Pipettor 100 can be configured with any number of pick-up poppets and dispense poppets, and the present invention is not limited to the illustrated embodiment with two pick-up poppets and one dispense poppet. In an embodiment that includes a plurality of pick-up poppets, the volume of air displaced by the dispense poppet should be greater than the volume of air displaced by each of the plurality of pick-up poppets. This will ensure that all of the fluid drawn into the pipette tip through operation of any of the pick-up poppets can be completely expelled. Multiple dispense poppets can also be used to ensure that the volume of air displaced by at least one dispense poppet is greater than the volume of air displaced by each of the pick-up poppets to ensure that fluid is completely expelled from the pipette tip.

The use of pick-up poppets 152 and 154 enables a calibrated volume of fluid to be drawn into pipette tip 130. This feature eliminates the need for pipette tip 130 to be graduated, so that pipettor 100 can be used with any type of pipette tip. This feature also relieves the user of the task of measuring the fluid drawn into pipette tip 130, thereby making pipettor 100 easier to use.

The pipettor of the present invention is particularly suited for pipetting calibrated volumes of fluid in the range of approximately 1 $\mu$l to approximately 200 $\mu$l. Optimally, the pipettor of the present invention is used for pipetting calibrated volumes of fluid in the range of approximately 1 $\mu$l to approximately 25 $\mu$l.

Figure 3B:
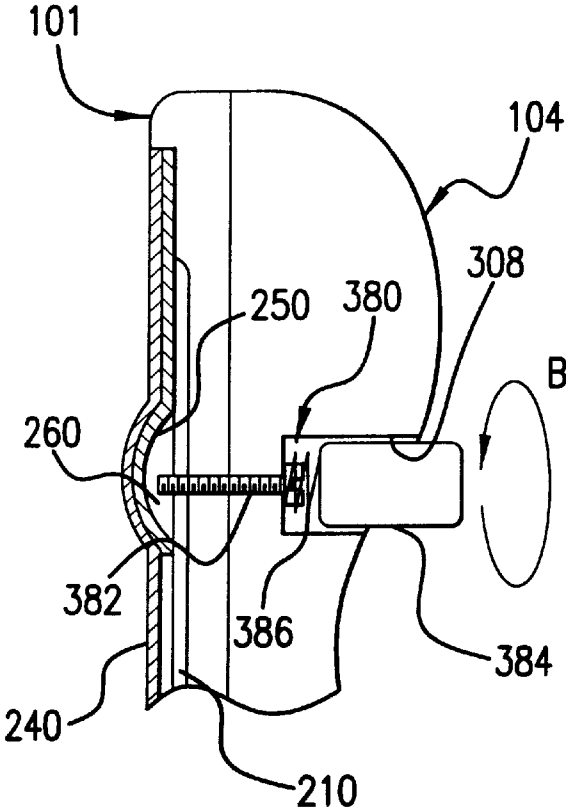
FIG. 3B shows a partial cross-section of the pipettor to illustrate another embodiment of a volume adjusting means.
Figure 3A:
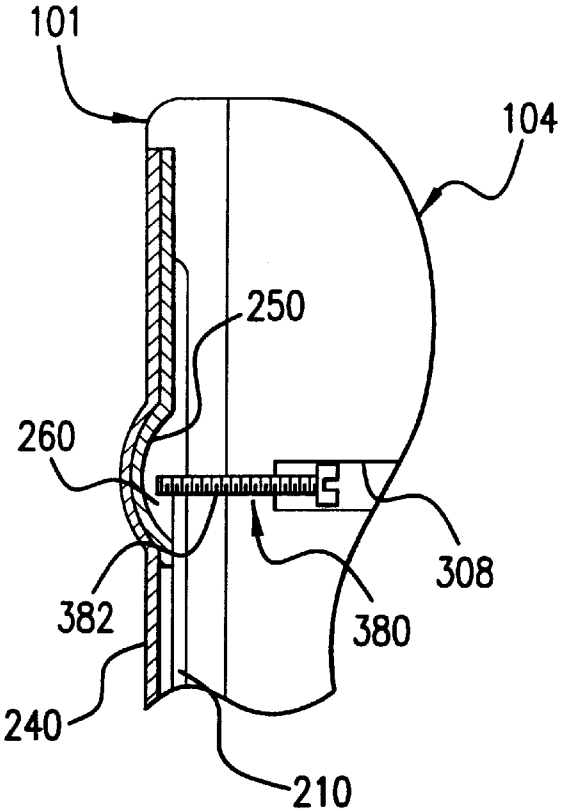
FIG. 3A shows a partial cross-section of the pipettor to illustrate one embodiment of a volume adjusting means.

FIG. 3A shows a partial cross-section of the pipettor of the present invention to illustrate one embodiment of a volume adjusting means 380. Volume adjusting means 380 is used to adjust or change the calibrated volume of fluid drawn into the pipettor of the present invention by changing the volume of air 260 displaced by poppet 250. Volume adjusting means 380 comprises a travel limiting screw 382 for changing a distance poppet 250 travels during deflection. Travel limiting screw 382 is disposed in a recess or access bore 308 in non-tubular body 101. In the embodiment of the pipettor shown in FIGS. 1A–1C and 2A–2C, the poppets bottom out on operating surface 102 of non-tubular body 101. In the embodiment shown in FIGS. 3A and 3B, poppet 250 bottoms out on travel limiting screw 382, thereby allowing travel limiting screw 382 to control the deflection distance of the poppet. Travel limiting screw 382 shown in FIG. 3A can be adjusted by, for example, a screw driver.

In the embodiment shown in FIG. 3B, travel adjusting means 380 further comprises a detented knob 384 for positioning travel limiting screw 382 into positions corresponding to a plurality of calibrated volumes of fluid. Knob 384 can be retained in the various detented calibrated positions through the use of a spring 386. To adjust the calibration, a user rotates knob 384, as shown generally by arrow B. Rotation of knob 384 causes travel limiting screw 382 to move, thereby changing the deflection distance for poppet 250. Changing the deflection distance for poppet 250 changes the volume of air 260 that is displaced, thereby changing the calibrated volume of fluid drawn into the pipettor. The detents of knob 384 can be readily configured by one of skill in the relevant arts to correspond to various calibrated volumes of fluid.

The embodiments shown in FIGS. 3A and 3B can also include a reduction means (not shown) for increasing the dynamic range associated with travel limiting screw 382 and knob 384. Such a reduction means would provide for greater movement of travel limiting screw 382 and knob 384 associated with a change in volume of air that is displaced. Such a reduction means can be readily configured by one of sill in the relevant arts.

Figure 4:
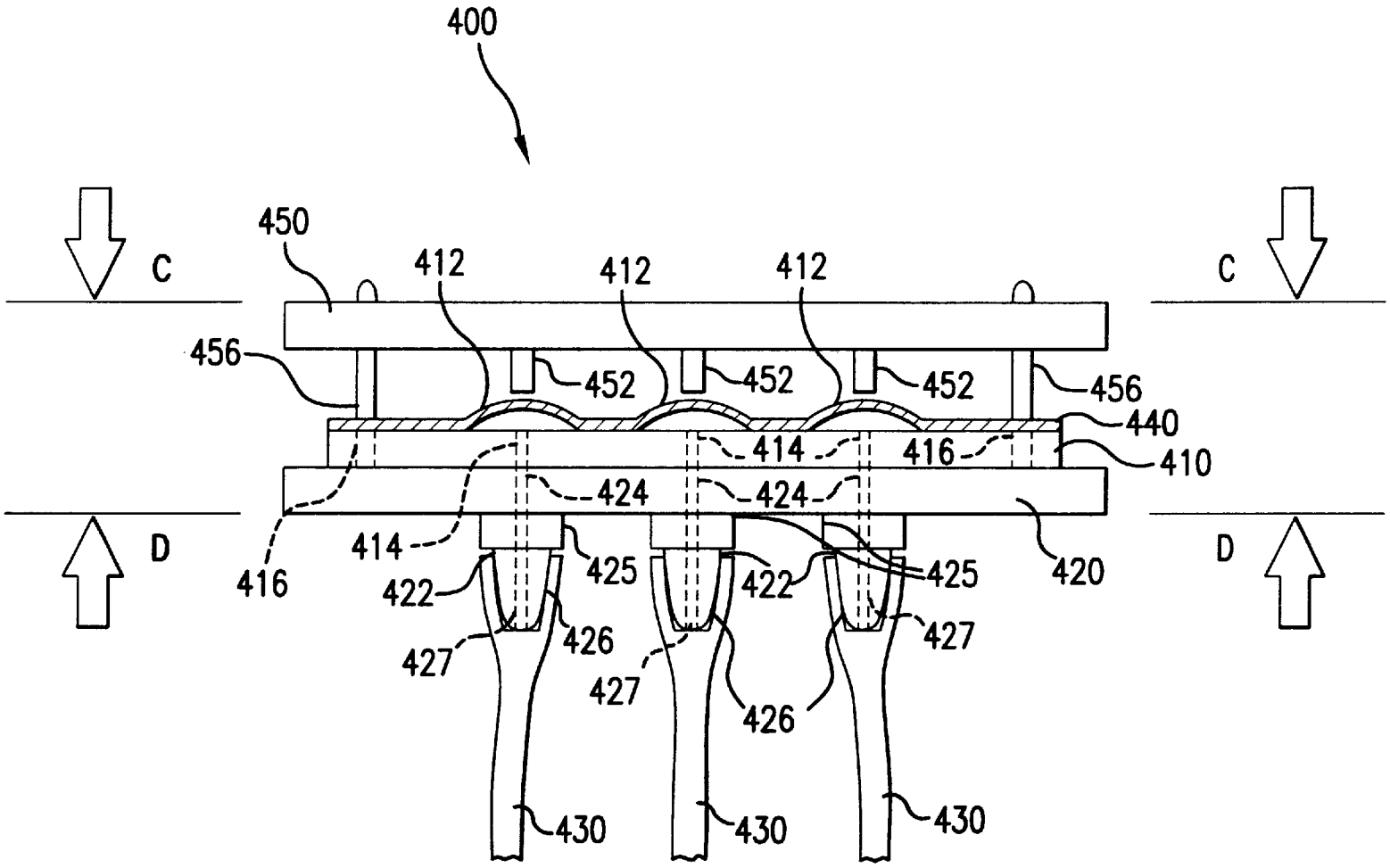
FIG. 4 shows one embodiment of a pipetting apparatus of the present invention.

Turning now to FIG. 4, one embodiment of a pipetting apparatus 400 of the present invention is shown. Pipetting apparatus 400 is configured to simultaneously perform multiple pipetting operations. Pipetting apparatus 400 includes a tip plate 420 that defines one or more tip plate air channels 424. One or more tip holders 422 are coupled at ends 425 to tip plate 420. Each of tip holders 422 defines a central bore 427 that is substantially aligned with a corresponding tip plate air channel 424. Each of tip holders 422 includes a tapered end 426 remote from tip plate 420 that is configured to mate with a pipette tip 430.

A poppet plate 410 defines one or more poppet plate air channels 414. Poppet plate 410 is removably disposed on tip plate 420 so that one end of each of poppet plate air channels 414 is substantially aligned with a corresponding tip plate air channel 424. One or more poppets 412 are disposed on poppet plate 410. Poppets 412 are disposed over the other end of poppet plate air channels 414. A sealing label 440, analogous to sealing label 240 described above, is disposed on poppet plate 410. Sealing label 440 covers poppets 412, and seals poppet plate air channels 414.

In the embodiment shown in FIG. 4, a pin plate 450 is used to actuate pipetting apparatus 400. Pin plate 450 is disposed in facing relation to poppet plate 410. One or more poppet pins 452 that extend toward poppet plate 410 are coupled to pin plate 450. When pin plate 450 and poppet plate 410 are drawn together, each poppet pin 452 deflects a corresponding poppet 412. Deflection of poppet 412 displaces air in the corresponding poppet plate air channel 414 and tip plate air channel 424 so that fluid can be drawn into or expelled from pipette tip 430. Pin plate 450 and poppet plate 410 can be drawn together by moving pin plate 450 in the direction shown by arrows C, and/or by moving tip plate 420 in the direction shown by arrows D. Other means for actuating pipetting apparatus 400 can be used. For example, poppets 412 could be deflected pneumatically, rather than through use of poppet pins 452.

To facilitate alignment between tip plate 450 and poppet plate 410, guide pins 456 are coupled to pin plate 450. Guide pins 456 are received within guide channels 416 defined by poppet plate 410 when pin plate 450 and tip plate 420 are drawn together.

The embodiment of pipetting apparatus 400 illustrated in FIG. 4 is preferably used to deliver one fixed calibrated volume of fluid through each of the plurality of pipette tips 430. To change the volume of fluid drawn into the pipette tips, poppet plate 410 is removed, and replaced with another poppet plate that displaces a different volume of air, thereby corresponding to a different volume of fluid. In an alternate embodiment, poppets 412 on poppet plate 410 vary so that varying volumes of fluid are drawn into the pipette tips. Alternatively, pipetting apparatus 400 could be configured with volume adjusting means, such as that described above with respect to FIGS. 3A and 3B, to change the volume of fluid.

Pipetting apparatus 400 can be configured to pipette into a pre-determined array of receiving wells. For example, pipetting apparatus 400 can be configured in an array corresponding to a standard 96-well microtiter plate. Alternatively, pipetting apparatus 400 can be configured to pipette into a plurality of receiving wells configured in any suitable format, such as a linear array.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A pipettor operable by a lateral pushing movement of a thumb of a user, comprising:

a non-tubular body having an operating surface and a supporting surface, said body configured to be grasped between the thumb placed on said operating surface and at least one finger placed on said supporting surface in an opposing manner, said body defining an air channel having an end open to the exterior of said body;

a tip holder coupled to said body at said end of said air channel, wherein an end of said tip holder remote from said body is configured to mate with a pipette tip;

a pick-up poppet disposed on said operating surface of said body, wherein deflection of said pick-up poppet by the lateral pushing movement of the thumb displaces a first volume of air in said air channel so that, upon release of said pick-up poppet, a calibrated volume of fluid is drawn into the pipette tip; and a dispense poppet disposed on said operating surface of said body, wherein deflection of said dispense poppet by the lateral pushing movement of the thumb displaces a second volume of air in said air channel greater than said first volume of air so that the calibrated volume of fluid is dispensed from the pipette tip.

2. The pipettor of claim 1, further comprising:

a second pick-up poppet disposed on said operating surface of said body, wherein deflection of said second pick-up poppet by the lateral pushing movement of the thumb displaces a third volume of air in said air channel so that, upon release of said second pick-up poppet, a second calibrated volume of fluid is drawn into the pipette tip.

3. The pipettor of claim 2, wherein the second calibrated volume of fluid is different than the first calibrated volume of fluid.

4. The pipettor of claim 2, wherein said second pick-up poppet comprises a deformable stainless steel disk.

5. The pipettor of claim 1, further comprising:

a sealing label disposed on said operating surface of said body, wherein said sealing label seals said air channel.

6. The pipettor of claim 1, further comprising:

ejecting means disposed in said body for ejecting the pipette tip from said tip holder.

7. The pipettor of claim 6, wherein said ejecting means comprises:

a lever having a first end extending from said body adjacent said tip holder and a second end, remote from said first end, extending from said body; and biasing means for biasing said lever in a non-contacting position wherein said first end is free from contact with the pipette tip, wherein depressing said second end causes said first end to push the pipette tip from said tip holder, and releasing said second end causes said first end to return to the non-contacting position.

8. The pipettor of claim 1, wherein said pick-up poppet and said dispense poppet each comprise a deformable stainless steel disk.

9. The pipettor of claim 1, further comprising:

volume adjusting means disposed in said body for adjusting the first volume of air displaced by deflection of said pick-up poppet.

10. The pipettor of claim 9, wherein said volume adjusting means comprises:

a travel limiting screw for changing a distance said pick-up poppet travels during deflection.

11. The pipettor of claim 10, wherein said volume adjusting means further comprises:

a detented knob for positioning said travel limiting screw into positions corresponding to a plurality of calibrated volumes of fluid.

12. The pipettor of claim 1, further comprising:

a plurality of additional pick-up poppets disposed on said operating surface of said body, wherein the second volume of air displaced by said dispense poppet is greater than a volume of air displaced by each of said plurality of additional pick-up poppets.

13. The pipettor of claim 1, wherein the calibrated volume of fluid is in the range of approximately 1 $\mu l$ to approximately 200 $\mu l$.

14. A pipettor operable by a lateral pushing movement of a thumb of a user, comprising:

a non-tubular body having an operating surface and a supporting surface, said body configured to be grasped between the thumb placed on said operating surface and at least one finger placed on said supporting surface in an opposing manner;

a tip holder coupled to said body, wherein an end of said tip holder remote from said body is configured to mate with a pipette tip;

first fluid pick-up means disposed in said body for drawing a first calibrated volume of fluid into the pipette tip, wherein said first fluid pick-up means is operable by the lateral pushing movement and release of the thumb against said operating surface;

second fluid pick-up means disposed in said body for drawing a second calibrated volume of fluid into the pipette tip, wherein said second fluid pick-up means is operable by the lateral pushing movement and release of the thumb against said operating surface; and dispensing means disposed in said body for dispensing the first and the second calibrated volumes of fluid from the pipette tip, wherein said dispensing means is operable by the lateral pushing movement of the thumb against said operating surface.

15. The pipettor of claim 14, wherein the second calibrated volume of fluid is different than the first calibrated volume of fluid.

16. The pipettor of claim 14, further comprising:

ejecting means disposed in said body for ejecting the pipette tip from said tip holder.

17. The pipettor of claim 16, wherein said ejecting means comprises:

a lever having a first end extending from said body adjacent said tip holder and a second end, remote from said first end, extending from said body; and biasing means for biasing said lever in a non-contacting position wherein said first end is free from contact with the pipette tip, wherein depressing said second end causes said first end to push the pipette tip from said tip holder, and releasing said second end causes said first end to return to the non-contacting position.

18. The pipettor of claim 14, further comprising:

a support ledge formed on said supporting surface, said support ledge aiding the user to grasp and operate the pipettor.

19. The pipettor of claim 14, further comprising:

volume adjusting means disposed in said body for adjusting the first calibrated volume of fluid.

20. The pipettor of claim 19, further comprising:

second volume adjusting means disposed in said body for adjusting the second calibrated volume of fluid.

21. The pipettor of claim 14, wherein the first calibrated volume of fluid and the second calibrated volume of fluid are in the range of approximately 1 $\mu$l to approximately 200 $\mu$l.

22. A pipetting apparatus, comprising:

a tip plate defining a tip plate air channel;

a tip holder coupled to said tip plate, wherein a central bore of said tip holder is substantially aligned with said tip plate air channel and an end of said tip holder remote from said tip plate is configured to mate with a pipette tip;

a poppet plate defining a poppet plate air channel, wherein said poppet plate is disposed on said tip plate so that a first end of said poppet plate air channel is substantially aligned with said tip plate air channel;

a poppet disposed on said poppet plate at a second end of said poppet plate air channel remote from said first end;

a pin plate disposed in facing relation to said poppet plate; and a poppet pin coupled to said pin plate so that said poppet pin extends toward said poppet plate, wherein, when said pin plate and said poppet plate are drawn together, said poppet pin deflects said poppet to thereby displace air in said poppet plate air channel and said tip plate air channel, and wherein, when said pin plate is moved away from said poppet plate, said poppet is permitted to return to its undeflected state and thereby draw a fluid into the pipette tip.

23. The pipetting apparatus of claim 22, further comprising:

a guide pin coupled to said pin plate so that said guide pin extends toward said poppet plate; and a guide channel defined by said poppet plate for receiving said guide pin when said pin plate and said poppet plate are drawn together.

24. The pipetting apparatus of claim 22, further comprising:

a sealing label disposed on said poppet plate, wherein said sealing label covers said poppet and seals said poppet plate air channel.

25. A pipettor for dispensing calibrated quantities of fluid, comprising:

a pipettor body defining an air channel having an end open to the exterior of said body;

means, on said body, for receiving a pipettor tip and coupling said end of said air channel to an interior of said pipettor tip;

at least one pick-up poppet, mounted on said body and in communication with said air channel, for drawing a calibrated volume of fluid into a pipettor tip mounted on said receiving means; and at least one dispense poppet, mounted on said body and in communication with said air channel, for dispensing the calibrated volume of fluid from a pipettor tip mounted on said receiving means.

26. The pipettor of claim 25, wherein said at least one pick-up poppet and said at least one dispense poppet each comprise a deformable stainless steel disk.

27. The pipettor of claim 25, further comprising:

volume adjusting means, operating in conjunction with said at least one pick-up poppet, for adjusting the calibrated volume of fluid drawn into a pipettor tip upon depression and release of said at least one pick-up poppet.

* * * * *